US006888325B2

(12) United States Patent
Hong et al.

(10) Patent No.: US 6,888,325 B2
(45) Date of Patent: May 3, 2005

(54) METHOD FOR SELF CORRECTING INNER PIN DISTORTION USING HORIZONTAL DEFLECTION COIL AND DEFLECTION YOKE THEREOF

(75) Inventors: Yun Ki Hong, Suwon-Shi (KR); Hwan Seok Choe, Suwon-Shi (KR); Gong Hee Park, Ansan-Shi (KR)

(73) Assignee: Samsung Electro-Mechanics Co., Ltd, Kyungki-Do (KR)

( * ) Notice: Subject to any disclaimer, the term of this patent is extended or adjusted under 35 U.S.C. 154(b) by 152 days.

(21) Appl. No.: 10/602,794

(22) Filed: Jun. 23, 2003

(65) Prior Publication Data

US 2004/0017165 A1 Jan. 29, 2004

(30) Foreign Application Priority Data

Jul. 26, 2002 (KR) ..... 10-2002-0044100
Apr. 8, 2003 (KR) ..... 10-2003-0022069

(51) Int. Cl.[7] ..... G09G 1/04

(52) U.S. Cl. ..... 315/370; 315/399; 335/210; 335/213; 313/440; 313/431

(58) Field of Search ..... 315/8, 364, 368.15, 315/370, 369, 399, 411; 335/210, 213, 299; 313/413, 440, 431

(56) References Cited

U.S. PATENT DOCUMENTS 3,984,723 A * 10/1976 Gross et al. ..... 313/412
4,023,129 A * 5/1977 Kratz et al. ..... 335/210
4,143,346 A * 3/1979 Borkar et al. ..... 335/213
6,380,667 B1 * 4/2002 Yokota et al. ..... 313/440

FOREIGN PATENT DOCUMENTS

JP 11-261839 A1 9/1999

* cited by examiner

*Primary Examiner*—Haissa Philogene
(74) *Attorney, Agent, or Firm*—Darby & Darby

(57) ABSTRACT

Disclosed is a method for correcting inner pin distortion generated in the CRT product and deflection yoke thereof. According to the disclosed method and deflection yoke thereof, the additional circuit for suppressing inner pin distortion phenomenon on the screen is not required as the related art, reduction in manufacturing costs is possibly achieved. Also, as the circuit for suppressing pincushion is not used, power dissipation could be reduced, and instability in dispersion and characteristics of a pin in the middle portion due to increase of dispersion generation by a wiring of a coil could be resolved.

6 Claims, 13 Drawing Sheets

METHOD FOR SELF CORRECTING INNER PIN DISTORTION USING HORIZONTAL DEFLECTION COIL AND DEFLECTION YOKE THEREOF

BACKGROUND OF THE INVENTION

1. Field of the Invention

The present invention relates to a method for correcting a pin distortion phenomenon generated in a CRT product (Cathode-Ray Tube product) and more particularly to a method and deflection yoke thereof, for self correcting a pin distortion using a horizontal deflection coil, capable of improving pincushion in a middle portion by extending effective electric field at a specific region in a diagonal on a screen bent part of the horizontal deflection coil.

2. Description of the Related Art

In general, the CRT is a picture tube for displaying an image in a TV set and is also called a brown tube, showing high brightness, wide angle of vision range, low manufacturing costs, high contrast, so that the CRT currently still prevails throughout the world. The principle of the CRT is that when a metal is heated to a high temperature, an electron within an atom constituting the metal is separated from the atom and emitted to a space and the CRT makes use of such thermal electron emission principle.

The CRT is divided into a Shadow Mask Type, Chromatron Type, Trinitron Type, etc., and most of a color TV set mainly uses the Shadow Mask Type where the Shadow Mask of a shallow iron plate having about 300 thousand fine holes on it, is provided at the position 10 mm apart from phosphor surface.

Operation for realizing a color image on a screen of the CRT will be briefly described. An object is decomposed into three color signal components with use of optical filters of red, green, blue and transmitted, and the receiver side prepares a screen surface on which phosphor film for emitting light in red, green, blue is plastered, synthesizing these three color signal components, thereby realizing original color of the object.

Namely, phosphor points of red, green, blue are plastered on the screen surface on which an image is displayed, and three electron guns respectively responsible for red, green, blue signals are necessary in order to get these phosphor points to emit light. Also, a deflection yoke is necessary so that each electron beam emitted from the electron guns passes through a shadow mask, exactly reaching each phosphor point.

An electric image generated on a target surface of a camera tube consists of lots of points having different amount of charges, and the electric image should be decomposed sequentially from left upper end to right lower end in order to be output in form of an image signal. Also, the image signal decomposed and transmitted in this manner is sequentially assembled to become an image at the receiver side. Such decomposition and assembling of an image are referred to scanning.

Such scanning is performed in form of a horizontal scanning from left to right and a vertical scanning from up to down, and in an actual TV set, scanning is performed in very high speed with use of a fixed 525 scanning lines and it takes about 1/30 second to scan the whole screen. Namely, 30 images are transmitted per one second so that the screen appears continuous to a human eye.

But, actually scanning is performed from up to down and from left to right according to time, so that the upper side is erased and a little blinking is generated on the whole screen. In order to prevent such blinking, an interlaced scanning for repeating 262.5 scanning lines twice is used.

The deflection yoke plays a role of properly performing scanning of the electron beam and electromagnetic force of the deflection yoke influences on the electron beam going straight on, so that progressing direction of the electron beam is bent and scanning is performed with the electron beam moved up and down, right and left on the whole.

Namely, the deflection yoke is the most important element among magnetic devices of the CRT and plays a role of getting an electric signal transmitted to a time series, to be played in form of an image on the screen of the CRT.

In other words, if the electron beam discharged from the electron gun is illuminated onto the screen by high voltage, simply the phosphor only on the center of the screen is lighted. Therefore, the outside makes operation of deflecting the electron beam to reach onto the screen in an order of scanning. Such deflection yoke generates magnetic field, exactly deflecting the electron beam onto the phosphor film plastered on the screen of the CRT, using the phenomenon that the electron beam change its progressing direction, influenced by magnetic field when the electron beam passes through magnetic field.

The CRT, which is a displaying apparatus for realizing an image in the general TV set or computer monitor, and the deflection yoke provided to it, will be described in detail hereinafter with reference to the accompanying drawings.

FIG. 1 is a sided view of the general CRT. As shown in FIG. 1, the deflection yoke 104 is positioned at a RGB electron gun part 103 of a CRT 100, deflecting an electron beam discharged from an electron gun 103*a*, onto a phosphor film plastered on a screen surface 102.

The electron gun part 103 gathers electron flow emitted from a cathode, in form of a beam, concentrating the beam on one point of the phosphor film. For electron gun, an uni-potential electron gun type and a bi-potential electron gun type are used.

The uni-potential type electron gun has a relatively big spot when focused on the phosphor film, but has strong points that focus depth is deep and defocusing is small even in case that an error is more or less generated electrically or mechanically on the front of the phosphor film and deviation of the focus due to voltage change is small. Such uni-potential type electron gun is mainly used for an electron gun of a black and white brown tube.

In the meantime, the bi-potential type electron gun requires a high voltage for focusing only, so that its construction is more or less complicated, but has strong points that correction of a path of an electron beam is easy and crushing of an electron beam is small. This type electron gun is mainly used for a color brown tube.

The electron beam discharged from the electron gun passes through a hole of a shadow mask, emitting light by illuminating a corresponding phosphor point. As a diameter of the shadow mask hole is large, permeability of the electron gun gets superior and the screen gets brighter, but instead, possibility that a little color mixing is generated, increases.

Also, the permeability of the electron beam is about 15% through 18% on the center of the screen and only that portion contributes light emitting of the phosphor film and the rest collides on the shadow mask, disappearing in form of heat loss. To improve such heat loss, the back of the shadow mask is processed by black.

The phosphor of the phosphor film changes electrical energy into light energy upon collision of the electron beam. Here, selection of phosphor and plastering technology should be considered for appropriate color, continuation, and satisfactory life.

The deflection yoke 104 includes a pair of coil separators 110 vertically symmetric, and being combined to one single member. The coil separator 110 is provided to insulate a horizontal deflection coil 115 from a vertical deflection coil 116, and at the same time, to assemble positions of those coils in good order. The coil separator consists of: a screen part 111*a* joined to the side of the screen surface 102 of the CRT 100; a rear cover part 111*b*; and a neck part 112 extended integrally from the central surface of the rear cover part 111*b* and joined to the electron gun part 103 of the CRT 100.

The coil separator 110 having the foregoing construction, has, in its inner and outer peripheral surfaces, a horizontal deflection coil 115 and a vertical deflection coil 116 for generating horizontal deflection magnetic filed and vertical deflection magnetic field, respectively, using power source provided from the outside.

Also, a pair of ferrite cores 114 made of magnetic material is provided to enclose the vertical deflection coil 116, for strengthening magnetic field generated from the vertical deflection coil 116.

The rear cover part 111*b* of the coil separator 110 has a printed circuit board "p" in its one side, for controlling (e.g. supplying power source to the horizontal and vertical deflection coils 115 and 116) electrical signal for the deflection yoke through many circuit elements mounted.

If saw tooth wave currents of different frequencies are applied to the horizontal and vertical deflection coils 115 and 116, then the horizontal deflection coil 115 generates magnetic field line in vertical direction by Fleming's left hand rule so that force is given to the electron beam in horizontal direction, while the vertical deflection coil 116 generates magnetic field line in horizontal direction by the same rule so that force is given to the electro beam in vertical direction.

Therefore, three color-electron beams consisting of red R, green G, blue B discharged from the electron gun 113*a*, are deflected as much as a predetermined angle, respectively, whereby scanning position on the screen is determined.

In the meantime, the deflection yoke as shown in FIG. 1 is roughly classified into a Saddle-Saddle type shown in FIG. 2 and FIG. 3 depending on a wiring structure, and a Saddle-Toroidal type (not shown in the picture) whose wiring structure is more or less different from the Saddle-Saddle type.

The deflection yoke of the Saddle-Saddle type as shown in FIG. 2 and FIG. 3, is configured such that a horizontal deflection coil 115 of a Saddle type is mounted on up and down portions in the inner peripheral surface of the screen part of the coil separator having an approximately cylindrical shape, and a vertical deflection coil 116 of a Saddle type is mounted on right and left portions in the outer peripheral surface of the screen part.

Also, a ferrite core 114 of an approximately cylindrical shape is mounted on the outer peripheral surface of the screen part 111*a* of the coil separator 110, for strengthening magnetic field of the vertical deflection coil 116.

Furthermore, a coma free coil (not shown) for correcting COMA generated by the vertical deflection coil 116, is mounted on the vicinity of the outer periphery of a neck part 112 of the coil separator 110.

The Saddle-Toroidal type deflection yoke includes: a saddle type horizontal deflection coil 115 being installed on the upper/lower side of the inner periphery of the screen part of the approximately cylindrical shaped coil separator 110; a ferrite core 114 of an approximately cylindrical shape being installed on the outer periphery; a toroidal type vertical deflection coil 116 being wired along the upper/lower side of the ferrite core 114.

Also, a coma free coil (not shown) for correcting COMA generated by the vertical deflection coil 116, is provided in the vicinity of the outer periphery of the neck part 112 of the coil separator 110.

The rear cover part 111*b* of the coil separator 110 has a printed circuit board p in its one side, for controlling (e.g. supplying power source to the horizontal and vertical deflection coils 115 and 116) electrical signal for the deflection yoke through many circuit elements mounted.

The CRT having the foregoing construction starts to compete against the LCD and the PDP which are flat display devices, due to the recent trend of continued light weight and flatness for the display device in the display market.

The LCD and the PDP display devices currently playing an important role in the display device together with the CRT, will be briefly described in the following.

The monitors for use in desktop application are roughly classified into the CRT monitor and the TFT (Thin Film Transistor) LCD, and as the monitor gets bigger and bigger the CRT monitor shows much restrictions in space, so that demand for the LCD monitor is increasing gradually.

In early 1970s, the LCD began to be used for an electronic calculator of a segment type, and a display part of a watch, and was applied to an electronic organizer and is currently being used and applied to products including a PC (Personal Computer), a liquid crystal color television, car navigation system, etc.

In an early stage, the LCD did not show a very good performance in an aspect of display compared to the CRT, but recently TFT LCD has been developed, so that high contrast, wide angle of vision range, high resolution, rapid response are possibly obtained, and as a result of development of such TFT LCD, color image and moving picture image are possibly provided.

For display performances required for display device, there exist high contrast ratio, high brightness, high resolution, displaying property, rapid response performance, wide angel of vision range, etc. Though the simple matrix structure of the LCD of the related art could provide image information such as a character, a diagram, such simple matrix structure has a problem that property relations for those image information are conflicting each other.

Namely, if one property gets better, then other property gets worse, so that achieving high performance on the whole was unreasonable. Particularly, a problem of cross talk was generated.

In order to resolve such problems, the TFT LCD of active matrix structure, capable of improving displaying performance by adding switching element to each pixel, has been developed.

Operation principle of the TFT LCD will be described in the following, in which: liquid crystal, which is interim material between solid and liquid, is provided to between two shallow glass plates, and voltage difference between electrodes installed on the up and down glass plates, changes arrangement of liquid crystal molecules, whereby light and shade is generated, through which image is displayed.

Namely, the TFT LCD is a display device using a kind of optical switching phenomenon.

In the meantime, the PDP, which is a kind of flat display device, is a display device using gas discharge. The name 'plasma' has been put because a gas generated from the discharge is plasma. The PDP operates in the following manner, in which: plasma (mixture of neon and xenon gases) is inserted between two closed glass plates on the surface of which parallel electrode rods are mounted, where the glass plates are completely closed and the electrode rods form exact angle, thereby making a pixel.

At the moment, when voltage pulse passes through between the two electrode rods, the inserted gas brings about chemical reaction, changing into lightly ionized plasma state emitting UV (ultraviolet) radiation. The emitted UV radiation activates color phosphor, and visible light is generated from each pixel, and necessary image is realized by combination of such lights.

Vivid display is possibly achieved by the PDP, so that the PDP was used for factory automation or apparatus such as a vending machine, a gas gauge in early stage. But recently, as trend of small sizing, light weight, and high performance in display device is pursued, the PDP is now being used for electronic apparatus for office automation including the PC.

In the above, the CRT that has been dominantly used for a displaying apparatus, the LCD and the PDP which are new display apparatus recently being developed through lots of researches and investments, have been briefly described in their construction and characteristics.

New type of displaying apparatus such as the LCD and the PDP recently being developed, have a flat type screen, showing excellent resolution, so that they are mainly adopted for a monitor of a computer, a TV set and other electronic products having displaying apparatus. To meet such high quality trend of the displaying apparatus, the CRT that has been used up to now is also changing. The primary problems to be resolved for flatness of the CRT, are geometrical distortion and misconvergence.

Misconvergence phenomenon which is problematic in the CRT will be described hereinafter.

In the deflection yoke of the Saddle-Saddle type or Saddle-Toroidal type, the magnetic field generated from both sides of the deflection coil oppositely positioned, shows difference depending on distribution characteristics of the vertical and horizontal deflection coils and variations in relative current amount.

In that case, the electron beam consisting of three colors initially emitted from the neck part of the coil separator, i.e., the neck part integrally extended from the rear cover part and joined to the electron gun part of the CRT, has different properties in its vector trajectory due to position of each electron gun responsible for red, green, blue, and difference in magnetic field generated from the deflection coil, whereby miss convergence is generated on the screen.

In order for the image to be realized in the color monitor or brown tube, the electron beams coming from electron guns of red, green, blue positioned in the inside of CRT, should be precisely focused at one point simultaneously. Here, in case that red color and blue color get apart from the focus with respect to the reference of green color in the center, miss convergence represents the degree of being apart.

Once the miss convergence is generated, the character or picture is shown to be overlapped on the screen and unclear. The miss convergence gets worse at the peripheral region than the central region of the screen due to structural characteristics of the CRT.

Generally, for miss convergence represented on the screen, there exist landing error, distortion error, VCR (Vertical Center Raster) distortion, HCR, YV, YH, CV, PQH.

The landing error stands for the miss convergence such that the electron beams (R,G,B) coming from the electron guns are not precisely scanned to each pixel on the screen, but scanned with being inclined to the central region or the edge region of the screen from each pixel, meaning the miss convergence at the state of getting narrow or wide.

Also, the distortion error stands for the miss convergence at the state such that the manner the electron beams (B,G,R) are scanned on the screen, is apart from up and down sides of the screen, or is concentrated on the central region of the screen, so that the beams are not scanned on the edge region, meaning the miss convergence at the state of being barrel or pin.

The HCR (Horizontal Center Raster), as shown in FIG. 4, stands for the miss convergence such that the red beam (R) and the blue beam (B) are precisely scanned on the screen, while the green beam (G) is not precisely scanned at each pixel on the screen and error is generated in horizontal direction, whereby the green beam is positioned in the inside or outside of the red beam (R) and the blue beam (B), which forms horizontal unbalance.

In case of HCR distortion, a balance coil (BC) is additionally installed to move the core of the balance coil lest inductance difference of the horizontal deflection coil installed mainly in the upper and lower sides, should be generated, whereby matching and control of the inductance of the up and down horizontal deflection coil, are achieved.

The VCR (Vertical Center Raster), as shown in FIG. 5, stands for the miss convergence such that when white line is displayed in horizontal direction along the upper and lower region of the screen, the red beam (R) and the blue beam (B) are precisely scanned on the screen and matched while the green beam (G) is not precisely scanned at each pixel on the screen, whereby error is generated in vertical direction.

The VCR distortion is remarkably represented at the vicinity of the upper and lower region of the screen, while there is no change in the central region.

The coma free plays a role of making characteristics of the vertical center raster, i.e., sensitivities for the center of the red beam (R) and blue beam (B) in the measurement point on the vertical axis of the CRT and the miss convergence in the vertical direction for the green beam (G), well balanced. More specifically, pin magnetic field generated from the coma free cancels the barrel magnetic field generated from the vertical deflection coil, making the green beam (G) matched with the red beam (R) and the blue beam (B).

Also, CV stands for the miss convergence such that the red beam (R) and the blue beam (B) are scanned, with being crossed each other to the vertical direction from corner region of the screen, and YV, as shown in FIG. 6, stands for the vertical miss convergence such that horizontal line of the red beam (R) is deviated from the horizontal line of the blue beam (B) at the upper and the lower regions of Y axis under assumption that the screen is divided into X axis and Y axis. In that case, variable resistance is connected and installed at the vertical deflection coil on right and left sides, and relative intensity of the current flowing to the right and left sides of the vertical deflection coil, is controlled through adjustment of the variable resistance.

In the meantime, YH, as shown in FIG. 7, stands for the miss convergence such that the vertical line of the red beam (R) and the vertical line of the blue beam (B) are crossed each other, forming axis characteristics on the screen. Namely, YH represents the degree that the vertical line of the blue beam (B) is deviated from the red beam (R), which is the reference line, at the upper and the lower ends of the center on the screen, in which minus (−) is marked for the case that the vertical line of the blue beam (B) is deviated to the left from the red beam (R) while plus (+) is marked for the case that the vertical line of the blue beam (B) is deviated to the right from the red beam (R).

In the following, geometrical distortion (GD) of the CRT will be described. GD, as shown in FIG. 8 and FIG. 9, represents distorted state of the screen, not normal state.

Particularly, due to trend of flatness in the CRT, NS distortion and pin plus (+) phenomenon are generated. As illustrated in the analysis view of the magnetic field in the horizontal direction shown in FIG. 10, the magnetic fields of the upper and the lower regions on Y axis are wrapped to the outside, and PQH becomes minus (−) as shown in FIG. 11, and resultantly, the red beam (R) and the blue beam (B) get wider diagonally with respect to Y axis. FIG. 12 shows that NS distortion is getting plus (+) according to magnetic filed characteristics as shown in FIG. 10.

FIG. 13 through FIG. 15 show miss convergence and distortion according to magnetic field analysis for the vertical direction, in which FIG. 13, FIG. 14, FIG. 15, show the magnetic field for the vertical direction, the miss convergence, the distortion, respectively.

In the meantime, recently the research and development department for the CRT, is making much efforts to improve flatness characteristics of the CRT through reduction of the geometric distortion and miss convergence in order to meet the demand of the display market.

As a representative method for correcting pin distortion among many kinds of miss convergences, the method for changing inductance value (L) upon up and down deflection using a pair of bias magnets for applying a fixed bias to a pair of drum cores wired by a horizontal correcting coil, and a variable bias coil wired by a vertical correcting coil, has been used.

The foregoing method of the related art is disclosed in Japanese patent publication No. 11-261839. In the following, the method for correcting pin distortion of the related art will be described with reference to the drawing attached to the Japanese patent publication No. 11-261839.

Description will be made with reference to accompanying drawings. FIG. 16 is a circuit diagram showing an apparatus for correcting inner pin distortion of the related art, and FIG. 17 is a sided view showing a structure for crucial portion of a reactor for correcting inner pin distortion used for an apparatus for correcting inner pin distortion of the related art.

As shown in the above Figs., the apparatus for correcting inner pin distortion of the related art is configured such that a reactor 1 for correcting inner pin distortion including: two horizontal correcting coils L1 and L2 connected in series; one single vertical correcting coil L3; a pair of magnets 2 and 3 for applying a bias magnetic field to the horizontal correcting coils L1 and L2 and the vertical correcting coil L3, is provided, and the horizontal correcting coils L1 and L2 are connected with the horizontal deflection circuit, so that the vertical correcting coil is modulated by the period of the vertical deflection current and bias magnetic field is generated in opposite direction, whereby impedance of the horizontal correcting coil is changed and inner pin distortions at right and left on the screen are corrected.

Also, as shown in FIG. 17, the reactor 1 for correcting inner pin distortion has three correcting coils such as the first horizontal correcting coil L1 wound on the first core 4, the second horizontal correcting coil L2 wound on the second core 5, and the vertical correcting coil L3 wound on the third core 6.

Also, a pair of magnets 2 and 3 are arranged on both sides of the three cores 4 through 6, respectively, where one end of the magnet is S pole and the other end of the magnet is N pole.

Therefore, the directions of the wiring for the two horizontal correcting coils L1 and L2 are configured such that their magnetic fields are generated in reverse directions, respectively. In the meantime, the direction of the wiring for the vertical correcting coil L3 is configured such that the magnetic field (bias magnetic field) generated by a pair of the magnets 2 and 3 is opposite in its direction.

The reactor 1 for correcting inner pin distortion has the foregoing construction, and the apparatus for correcting distortion of the screen according to the related art, corrects pin distortion generated at right and left on the screen using such reactor 1 for correcting inner pin distortion.

In FIG. 16 and FIG. 17, the same reference numeral stands for the same element. Here, L4 and L5 stand for a horizontal deflection coil, and L6 and L7 stand for a vertical deflection coil, R1 through R4 stands for a resistance, VR1 stands for a variable resistance, D1 and D2 stand for a diode, respectively.

The reactor 1 for correcting inner pin distortion shown in FIG. 16, is an equivalent circuit, whose construction is illustrated in FIG. 17.

Also, in FIG. 16, the horizontal deflection coils L4, L5 and the vertical deflection coils L6, L7 are coils of the deflection yoke, and as is generally known, current of saw tooth wave having horizontal period is supplied to the horizontal deflection coil L4, L5 from a horizontal deflection circuit not shown, and current of saw tooth wave having vertical period is supplied to the vertical deflection coil L6, L7 from a vertical deflection circuit, so that the electron beam is deflected.

The procedure for correcting pin distortion using a related art having the foregoing construction, will be described with reference to FIG. 17 and FIG. 18 in the following.

In FIG. 18, when pin distortions depicted as thin dotted lines at the regions of the second point P2 and the fourth point P4, is generated, the magnetic field of the horizontal correcting coils L1 and L2 is generated by the current flowing in the horizontal deflection circuit, so that the inductance value L retained by a pair of the existing horizontal correcting coils L1 and L2 get reduced due to fixed bias magnetic field of the permanent magnets 2 and 3.

In addition, the variable bias generated from the vertical correcting coil L3, cancels the magnetic field of the permanent magnets 2 and 3 in opposite direction, whereby difference in inductance values for up and down is generated and the pin distortions for the regions of P2 and P4 are corrected (the portions denoted by the thin dotted lines disappear) by size difference for up and down.

But, for the method for correcting pin distortion of the related art as described above, each of the horizontal correcting coils and the vertical correcting coil should be wired on a plurality of the cores, so that productivity is lowered, and there exist problems that distribution and characteristics of the inner pin are unstable as distribution generation gets large due to wiring of the coils and unnecessary power dissipation gets increased as the correcting circuit is additionally mounted.

Namely, in FIG. 17, elements of each core generate repulsive force by the electromagnetic force of their own, so that gap is generated and corresponding power dissipation causes the foregoing problems.

SUMMARY OF THE INVENTION

To solve the above-indicated problems, it is, therefore, an object of the present invention to provide a method and deflection yoke thereof, for self correcting a pin distortion using a horizontal deflection coil capable of improving pincushion in a middle portion by extending effective electric field at a specific region in a diagonal on a screen bent part of the horizontal deflection coil, and at the same time, capable of achieving productivity improvement, price reduction, high quality.

The foregoing and other objects and advantages are realized by providing a method for self correcting a pin distortion using a horizontal deflection coil including a neck part, a screen bent part, an extension part connecting the neck part and the screen bent part and having a horizontal deflection coil installed on an upper and lower sides in an inner periphery of a coil separator of a deflection yoke, for generating horizontal deflection magnetic field, the method includes the steps of: generating pincushion at an edge region on a screen by dividing the screen bent part of the horizontal deflection coil into quadrants, respectively, and by extending an effective electric field length at a specific region of the extension part positioned in a diagonal direction of the screen bent part on each quadrant, closely to a plane in a rear side of the screen bent part; and correcting pincushion generated in the above step and self inner pin phenomenon of a middle portion by compensating a whole pincushion of the screen through control of a deflection controlling circuit of a display set.

Also, another aspect of a method for self correcting inner pin distortion using a horizontal deflection coil of the present invention, is that an interval range where the effective electric field length of the horizontal deflection coil is extended, exists within a position angle range of 28°–42° with respect to X axis on the divided quadrant of the screen bent part.

Still another aspect of a method for self correcting inner pin distortion using a horizontal deflection coil of the present invention, is that the extension length where the effective electric field length is extended with respect to the specific region of the horizontal deflection coil, exists within a range of 3% through 10% of the electric field length of the whole horizontal deflection coil.

The deflection yoke of the present invention includes: a coil separator having a screen part positioned on a screen surface of a cathode-ray tube, a rear cover part, a neck part extended from a central surface of the rear cover part and combined to an electron gun part of the cathode-ray tube; a vertical deflection coil installed on an outer periphery of the coil separator, for generating vertical deflection magnetic field; a horizontal deflection coil having a screen bent part, an extension part, a neck bent part, and installed on an inner periphery of the coil separator, for generating horizontal deflection magnetic field, and changing distortion pattern on a screen corner part by extending an effective electric field length of a specific region of the extension part positioned on a diagonal direction of the front screen bent part when seen from a screen side, closely to XY plane at a rear side of the screen bent part; and a ferrite core installed on an outer periphery of the coil separator, for strengthening deflection magnetic field.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

A preferred embodiment of the present invention will now be described with reference to the accompanying drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

On the first place, technical thoughts applied to the present invention will be briefly described. The deflection yoke has a pair of coil separators vertically symmetric and combined to one member, and the coil separator is provided for insulating the horizontal deflection coil from the vertical deflection coil and for assembling the positions of these deflection coils in good order as well. The coil separator consists of: a screen part joined to the side of the screen surface of the CRT; a rear cover part; and a neck part extended integrally from the central surface of the rear cover part and joined to the electron gun part of the CRT.

The coil separator having the foregoing construction, has, in its inner and outer peripheral surfaces, a horizontal deflection coil and a vertical deflection coil for generating horizontal deflection magnetic filed and vertical deflection magnetic field, respectively, using power source provided from the outside.

Also, a pair of ferrite cores made of magnetic material is provided to enclose the vertical deflection coil, for strengthening magnetic field generated from the vertical deflection coil.

Also, a printed circuit board having a circuit for correcting misconvergence on it, is installed on one side of the rear cover part of the deflection yoke.

Figure 1:
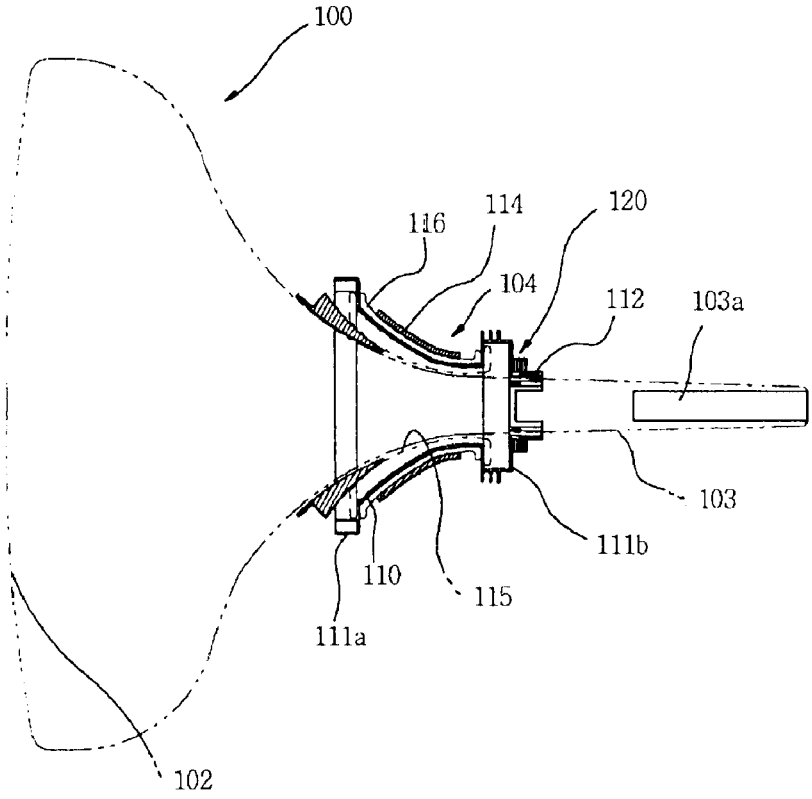
FIG. 1 (CONVENTIONAL ART)
FIG. 1 is a sided view of a CRT (Cathode Ray Tube) of the related art.
Figure 2:
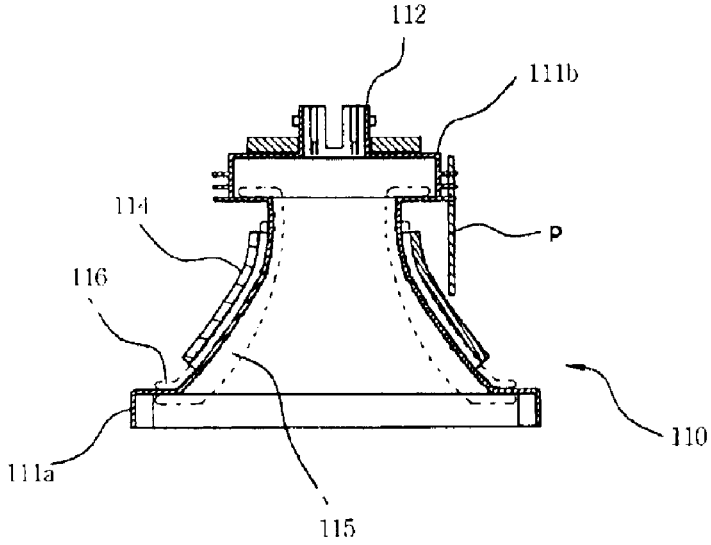
FIG. 2 (CONVENTIONAL ART)
FIG. 2 is a top, cross-sectional view of a Saddle-Saddle type deflection yoke of the related art.
Figure 3:
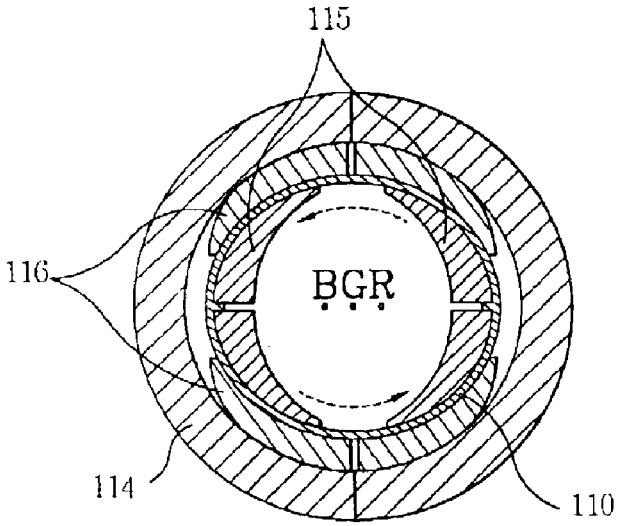
FIG. 3 (CONVENTIONAL ART)
FIG. 3 is a plan, cross-sectional view of FIG. 2.
Figure 4:
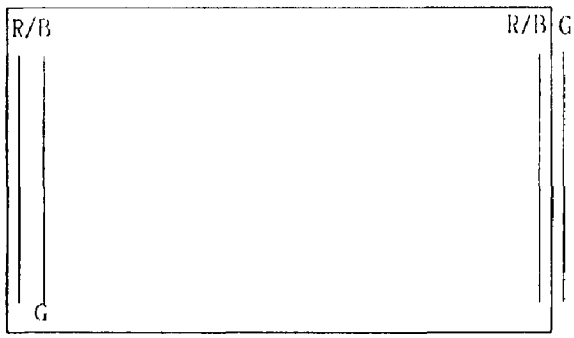
FIG. 4 (CONVENTIONAL ART)
FIG. 4 through FIG. 15 are exemplary views of miss convergences and geometric distortion patterns in the deflection yoke according to the related art.
Figure 5:
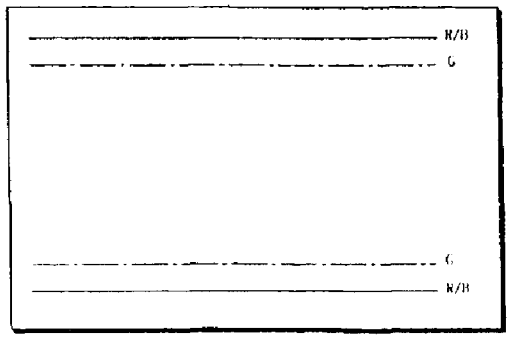
FIG. 5 (CONVENTIONAL ART)
Figure 6:
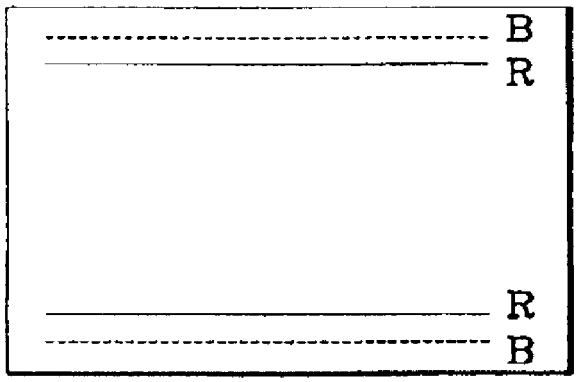
FIG. 6 (CONVENTIONAL ART)
Figure 7:
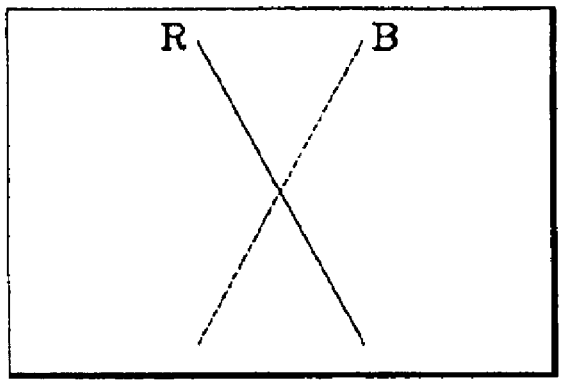
FIG. 7 (CONVENTIONAL ART)
Figure 8:
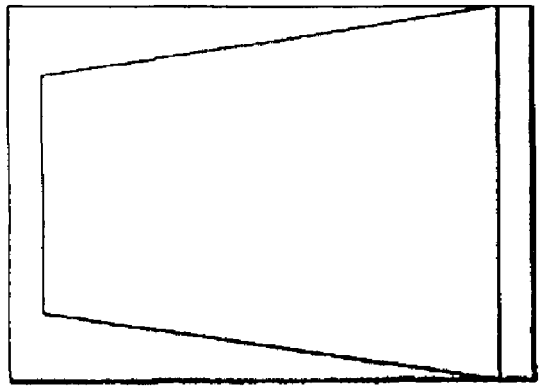
FIG. 8 (CONVENTIONAL ART)
Figure 9:
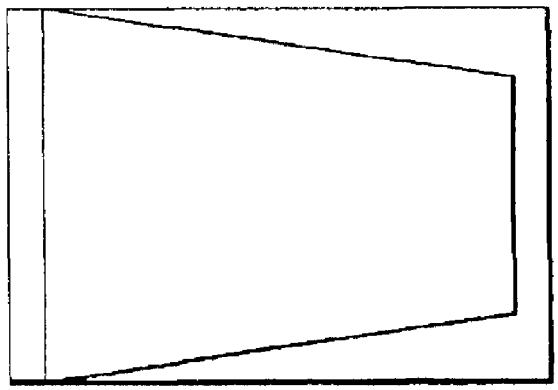
FIG. 9 (CONVENTIONAL ART)
Figure 10:
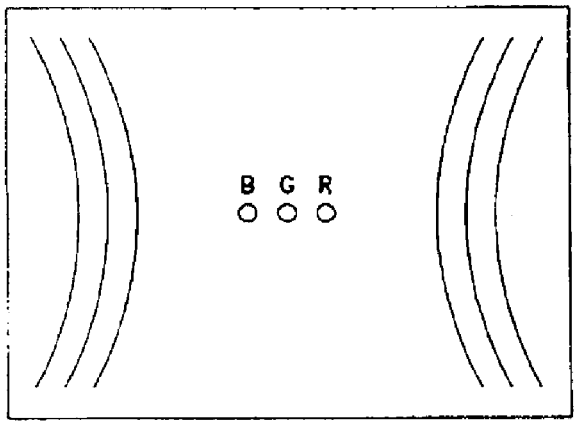
FIG. 10 (CONVENTIONAL ART)
Figure 11:
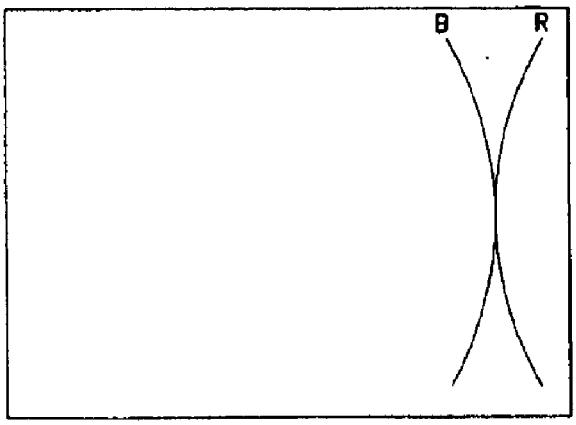
FIG. 11 (CONVENTIONAL ART)
Figure 12:
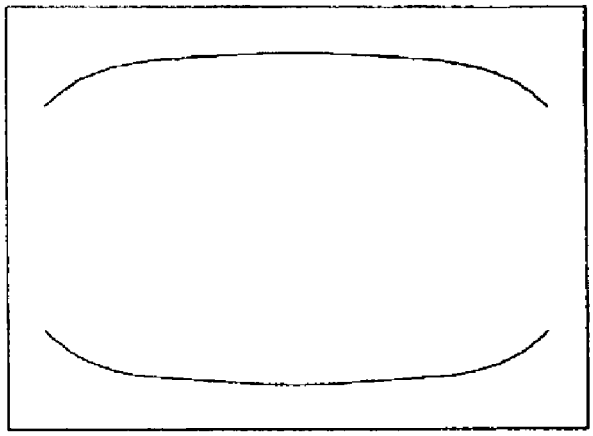
FIG. 12 (CONVENTIONAL ART)
Figure 13:
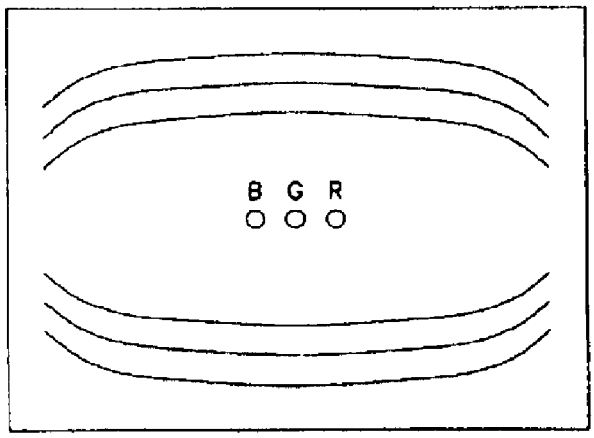
FIG. 13 (CONVENTIONAL ART)
Figure 14:
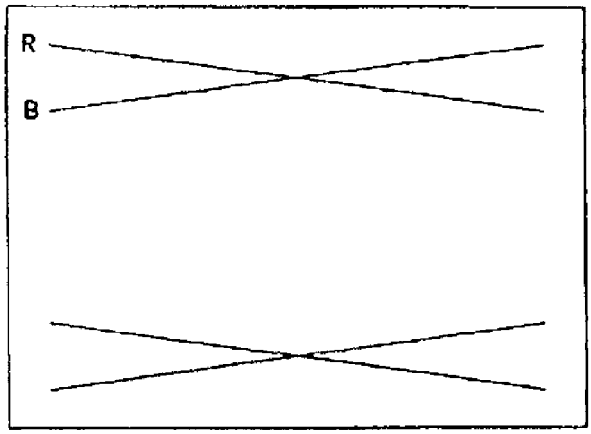
FIG. 14 (CONVENTIONAL ART)
Figure 15:
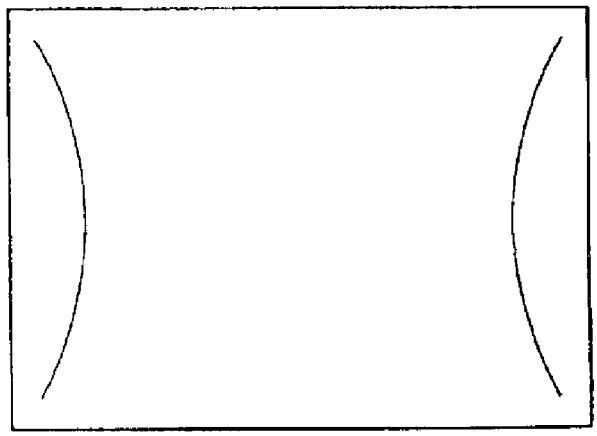
FIG. 15 (CONVENTIONAL ART)
Figure 16:
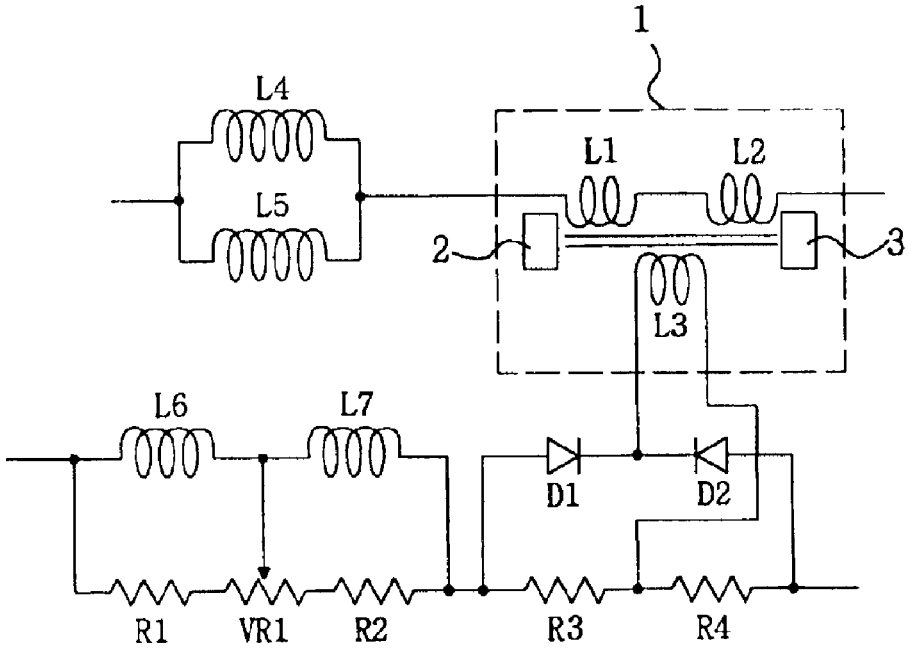
FIG. 16 (CONVENTIONAL ART)
FIG. 16 is an exemplary circuit diagram of an apparatus for correcting inner pin distortion of the related art.
Figure 17:
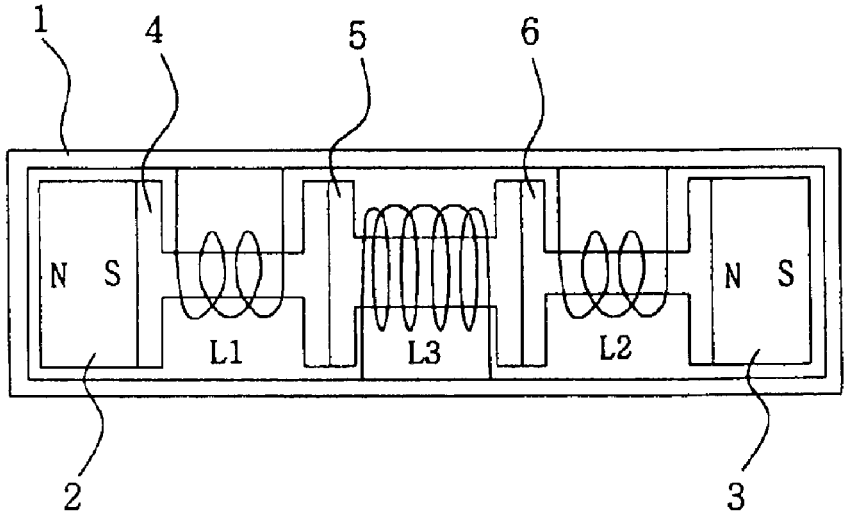
FIG. 17 (CONVENTIONAL ART)
FIG. 17 is an exemplary sided view for a crucial part construction of the reactor for correcting inner pin distortion used for an apparatus for correcting inner pin distortion of the related art.
Figure 18:
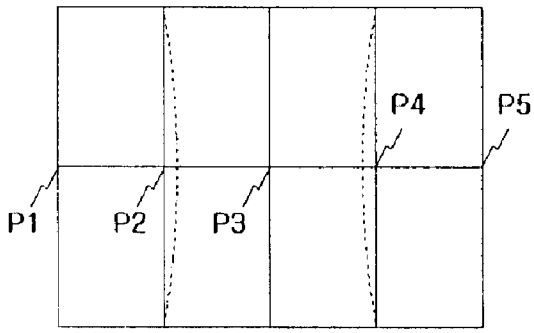
FIG. 18 (CONVENTIONAL ART)
FIG. 18 is an exemplary view of a screen upon correction of the inner pin distortion according to the related art.
Figure 19:
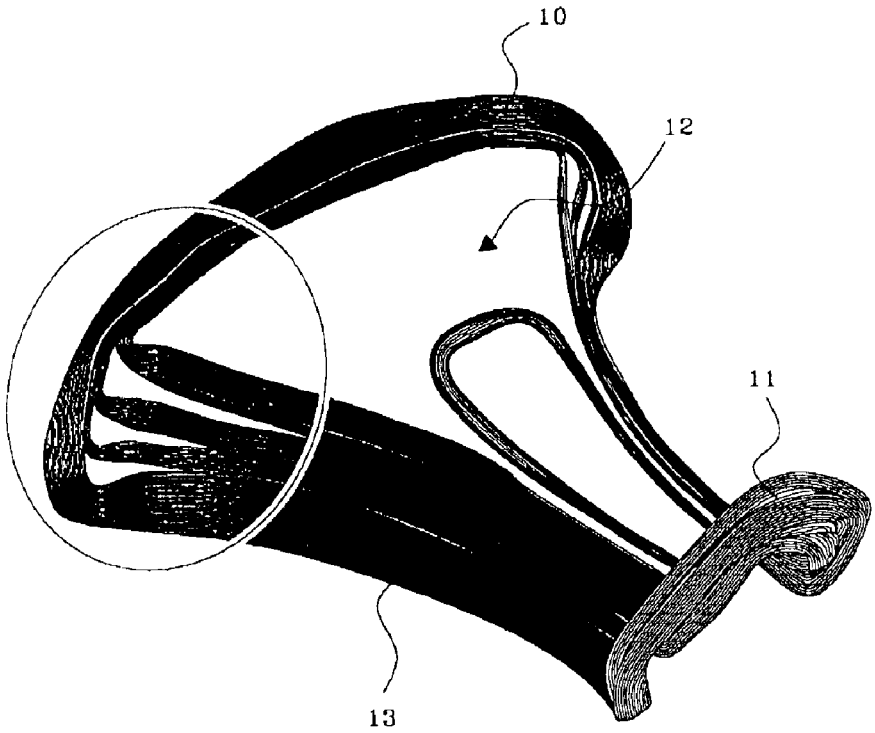
FIG. 19 (CONVENTIONAL ART)
FIG. 19 is a perspective view of a vertical deflection coil according the related art.

In the meantime, FIG. 19 shows the horizontal deflection coil of the related art. The horizontal deflection coil is installed on the coil separator (not shown) on which the printed circuit board is mounted. The horizontal deflection coil is divided into the neck part 11 (though the same terminology as the neck part of the coil separator is used in the present embodiment, designated position for each neck part is different), the screen bent part 10, respectively installed on the inner periphery of the coil separator, and the extension part 13 connecting the neck part 11 and the screen bent part 10. Here, a reference numeral 12 stands for the window.

At the moment, deflection force is substantially generated at the extension part 13, and the length of the extension part 13 from the neck part 11 to the screen bent part 10 is uniformly maintained in order to uniformly maintain deflection force.

Therefore, to resolve inner pin distortion phenomenon, the present invention prevents distortion phenomenon through compensation of the whole screen by forcibly distorting the portion where inner pin distortion actually does not occur. For that purpose, the length of the specific region where the extension part 13 is connected to the screen bent part 10 is transformed so that pincushion phenomenon is forcibly generated in the edge region on the screen. Resultantly, pincushion of the whole screen could be suppressed merely by control of the horizontal deflection controlling circuit for controlling pincushion of the whole screen.

Figure 20:
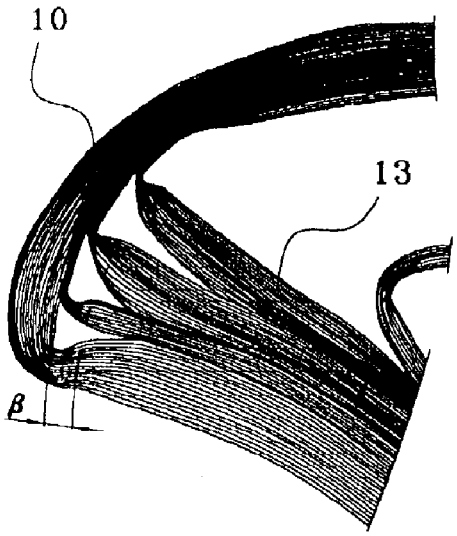
FIG. 20 (CONVENTIONAL ART)
FIG. 20 is a perspective view of a crucial part of the vertical deflection coil of the related art.

Namely, as shown in FIG. 20, an uniform interval $\beta$ whose slope angle changes, exists at the connection portion between the extension part 13 and the screen bent part 10. To resolve inner pin distortion phenomenon, the present invention transforms part of the uniform interval $\beta$ to prevent distortion phenomenon through compensation of the whole screen by forcibly distorting the portion where inner pin distortion actually does not occur.

A preferred embodiment of the present invention will be described in detail hereinafter with reference to the accompanying drawings.

Figure 21:
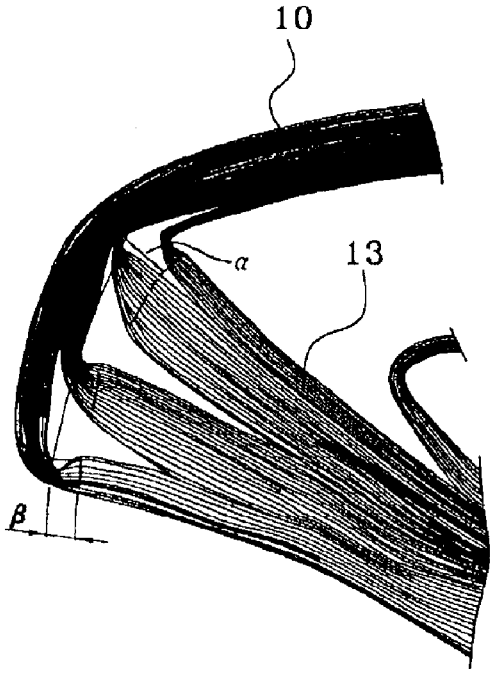
FIG. 21 is a partial, perspective view of a horizontal deflection coil for which a method for correcting inner pin distortion according to the present invention would be applied.

As shown in the accompanying FIG. 21, when the horizontal deflection coil which most greatly influences distortion of the screen is seen from the screen side, the length of the extension part corresponding to the specific region of the horizontal deflection coil positioned on the front diagonal direction of the screen bent part 10, is extended so that a separate interval a is formed besides the uniform interval $\beta$.

Figure 22:
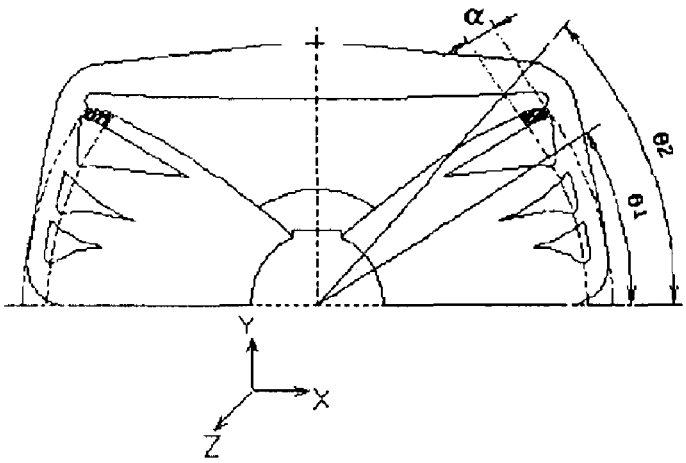
FIG. 22 is an exemplary view explaining extension interval of an effective electric field length of a horizontal deflection coil according to the present invention.

Namely, as shown in FIG. 22, when the horizontal deflection coil which most greatly influences distortion of the screen is seen from the screen side, the extension interval $\alpha$ is formed so that effective electric field approaches XY plane at the angle range ($\theta 1 \leqq \theta \leqq \theta 2$) of the specific region in the horizontal deflection coil positioned on the front diagonal direction of the screen bent part 10. With such extension interval $\alpha$, deflection force in X direction of the specific region is increased, so that the only distortion pattern on the corner part is mainly changed.

In that case, the extension interval range $\theta$ of the horizontal deflection coil is formed within the position angle range of 28°–42° with respect to X axis when the screen bent part of the deflection yoke is divided into quadrants.

In that case, the length of the extension part of the horizontal deflection coil is denoted by the reference numeral $\alpha$. Referring to FIG. 21, the range of the length "$\alpha$" of the coil extended according to the present invention is within the range of 3%–10% of the electric field length of the whole coil denoted by the reference numeral L.

Figure 23:
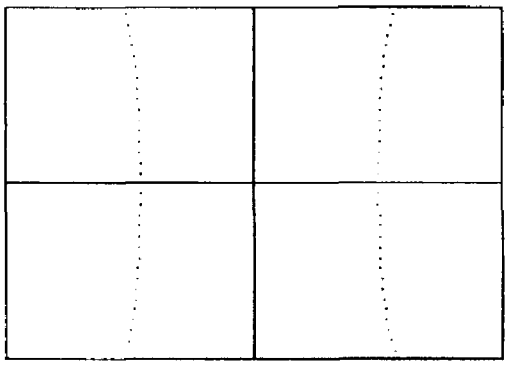
FIG. 23 through FIG. 25 are exemplary views explaining pin distortion correction effect according to a method for correcting inner pin distortion of the present invention.
Figure 24:
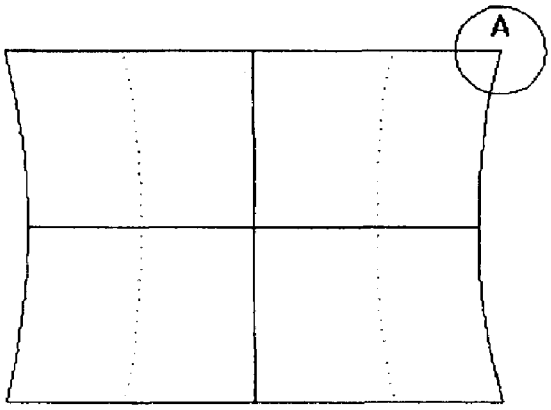
Figure 25:
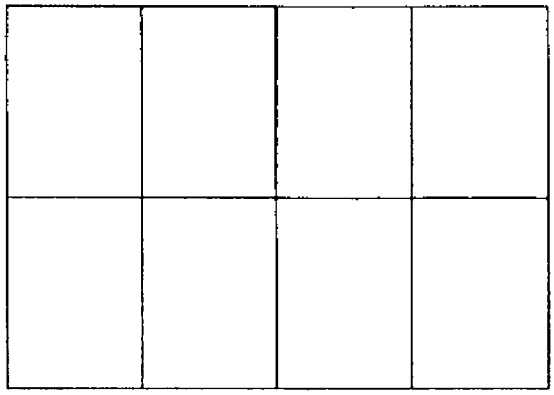

As shown in FIG. 21 and FIG. 22, in case that when the horizontal deflection coil which most greatly influences distortion of the screen is seen from the screen side, the specific region of the horizontal deflection coil positioned on the front diagonal direction of the screen bent part 10, is extended so that the specific region approaches the plane at the back of the screen bent part 10, and the effect thereof is shown in FIG. 23 through FIG. 25.

Namely, if the method for self correcting inner pin distortion using the horizontal deflection coil according to the present invention shown in FIG. 21 and FIG. 22 is applied to the case that the screen where inner pincushion is not resolved, is at the status of inner pincushion that has been problematic upon right and left comparison as shown in FIG. 23, then deflection force for only the portion denoted by the reference numeral A in FIG. 24 is increased, and resultantly the overall right and left pincushion due to the general deflection controlling circuit of the display set is improved as is clearly shown in FIG. 25.

Namely, merely with the general horizontal deflection controlling circuit provided to the display set, pincushion phenomenon is generated in the middle portion. Therefore, in order to correct such defect, deflection magnetic field in X axis of the horizontal side of the horizontal deflection coil is strengthened and pincushion phenomenon is forcibly generated at the edge region on the screen and after that, pincushion for the whole screen could be suppressed merely by the general horizontal deflection controlling circuit as described above.

As the method for self correcting inner pin distortion using the horizontal deflection coil and deflection yoke thereof according to the present invention does not need to have additional circuit as the related art in order to suppress inner pin distortion phenomenon on the screen, reduction in manufacturing costs is possibly achieved. Also, as the circuit for suppressing pincushion is not used, power dissipation could be reduced.

Also, in a related art, it was difficult to maintain stability in dispersion and characteristics of a pin in the middle portion as dispersion generation increases due to a wiring of a coil, but such difficulty could be resolved according to the present invention.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

What is claimed is:

1. A method for self correcting a pin distortion using a horizontal deflection coil having a neck part, a screen bent part, an extension part connecting the neck part and the screen bent part and having a horizontal deflection coil installed on an upper and lower sides in an inner periphery of a coil separator of a deflection yoke, for generating horizontal deflection magnetic field, the method comprising the steps of:

generating pincushion at an edge region on a screen by dividing the screen bent part of the horizontal deflection coil into quadrants, respectively, and by extending an effective electric field length at a specific region of the extension part positioned in a diagonal direction of the screen bent part on each quadrant, closely to a plane in a back of the screen bent part; and correcting pincushion generated in the above step and self inner pin phenomenon on a middle portion by compensating a whole pincushion of the screen through control of a deflection controlling circuit of a display set.

2. The method according to claim 1, wherein an interval range where the effective electric field length of the horizontal deflection coil is extended, exists within a position angle range of 28°–42° with respect to X axis on the divided quadrant of the screen bent part.

3. The method according to claim 1, wherein an extension length where the effective electric field length is extended with respect to the specific region of the horizontal deflection coil, exists within a range of 3%–10% of an electric field length of a whole horizontal deflection coil.

4. A deflection yoke comprising:

a coil separator having a screen part positioned on a screen surface of a cathode-ray tube, a rear cover part, a neck part extended from a central surface of the rear cover part and combined to an electron gun part of the cathode-ray tube;

a vertical deflection coil installed on an outer periphery of the coil separator, for generating vertical deflection magnetic field;

a horizontal deflection coil having a screen bent part, an extension part, a neck bent part, and installed on an inner periphery of the coil separator, for generating horizontal deflection magnetic field, and changing distortion pattern on a screen corner part by extending an effective electric field length of a specific region of the extension part positioned on a diagonal direction of a front screen bent part when seen from a screen side, closely to XY plane at a back of the screen bent part; and a ferrite core installed on an outer periphery of the coil separator, for strengthening deflection magnetic field.

5. The deflection yoke according to claim 4, wherein an interval range where the effective electric field length of the horizontal deflection coil is extended, exists within a position angle range of 28°–42° with respect to X axis on the divided quadrant of the screen bent part.

6. The deflection yoke according to claim 4, wherein an extension length where the effective electric field length is extended with respect to the specific region of the horizontal deflection coil, exists within a range of 3%–10% of an electric field length of a whole coil.

* * * * *